US006679766B2

(12) United States Patent
Schulz et al.

(10) Patent No.: US 6,679,766 B2
(45) Date of Patent: Jan. 20, 2004

(54) DIAMOND SLEEVE HONING TOOL

(75) Inventors: Andreas Schulz, Kentwood, MI (US); Peter Asslaender, Grand Rapids, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/123,805

(22) Filed: Apr. 16, 2002

(65) Prior Publication Data

US 2003/0194957 A1 Oct. 16, 2003

(51) Int. Cl.[7] ..... B24B 7/00

(52) U.S. Cl. ..... 451/180; 451/51; 451/177; 451/178; 451/179; 451/180

(58) Field of Search ..... 481/51, 177, 178, 481/179, 180; 451/51, 177, 178, 179, 180

(56) References Cited

U.S. PATENT DOCUMENTS

| | | | | |
|---|---|---|---|---|
| 2,472,554 A | | 6/1949 | Volis | |
| 2,702,446 A | | 2/1955 | Johnson | |
| 3,166,876 A | | 1/1965 | Manchester | |
| 3,526,057 A | * | 9/1970 | Hackman, Jr. | 451/178 |
| 4,155,721 A | | 5/1979 | Fletcher | |
| 5,022,196 A | | 6/1991 | Schimweg et al. | |
| 5,178,643 A | * | 1/1993 | Schimweg | 51/293 |
| 5,305,556 A | * | 4/1994 | Kopp et al. | 451/165 |
| 5,371,978 A | | 12/1994 | Higashikawa | |
| 5,390,448 A | | 2/1995 | Schimweg | |
| 6,074,282 A | | 6/2000 | Schimweg | |
| 6,139,414 A | | 10/2000 | Domanski et al. | |

OTHER PUBLICATIONS

Undated trade literature published by Accu–Cut Diamond Tool Company, Inc., Norridge, Illinois, 3 sheets.

* cited by examiner

*Primary Examiner*—Joseph J. Hail, III
*Assistant Examiner*—Shantese McDonald
(74) *Attorney, Agent, or Firm*—Brooks Kushman P.C.

(57) ABSTRACT

A honing tool assembly adapted to be chucked in a honing machine for reciprocation and rotation, the assembly comprising a diamond-plated tool for honing cylindrical bores in a workpiece, the diamond-plated tool having a spiral pattern on a cylindrical outer surface, a central bore in the tool adapted to receive a tapered rod engageable with a tapered surface on the central tool opening, the tool being provided with a longitudinal slot that allows the outside diameter of the tool to expand as a force is applied to the tapered rod whereby stock is removed from bore walls of the workpiece with precision roundness and concentricity.

2 Claims, 5 Drawing Sheets

DIAMOND SLEEVE HONING TOOL

BACKGROUND OF THE INVENTION

1. Field of the Invention

The invention relates to a honing tool with a diamond-plated surface for removing workpiece stock material.

2. Background Art

It is known practice in precision machining of a workpiece bore to use a diamond-plated tool that rotates and reciprocates within the bore. A honing tool can be used for removing stock as the honing tool rotates and reciprocates in the bore. Multiple tools of varying diameter are used during successive steps in the honing process. Another tool of known design comprises a cylindrical sleeve with a longitudinal opening that receives a metallic honing tool element, the radially outward edge of the element having an abrasive surface that removes stock from the interior of the bore. The innermost edge of the element is provided with a wedge surface that engages a companion wedge surface on the end of an actuator rod that can be adjusted axially with respect to the body of the honing tool. In this way, the effective operating diameter of the abrasive surface can be changed without changing tools during a honing operation. The amount of the stock removed depends upon the longitudinal positioning of the rod actuator relative to the tool.

Such honing tools have a relatively low tool life, and they are relatively costly to refurbish. In the case of high-volume manufacturing operations, tool refurbishing costs are enhanced because of the associated honing machine down time.

SUMMARY OF THE INVENTION

It is an objective of the invention to provide a precision honing tool for machining bores in a steel workpiece wherein the bore quality that can be achieved is not affected by the quality of the workpiece bore prior to machining and wherein the overall boring tool piece cost and the refurbishing cost are reduced.

A typical example of a workpiece that can be machined using the improved honing tool of the invention is a cylinder body for a diesel fuel injector for diesel engines. The cylinder body receives a plunger that is driven by a camshaft for the engine. In the case of a four-stroke cycle diesel engine, the injection stroke of the plunger will occur during each engine cycle, one stroke occurring for two revolutions of the engine camshaft.

The honing tool comprises a diamond-plated sleeve that can be expanded with a tapered mandrel extending through a central opening of the sleeve. Expansion may occur during rotation and oscillation of the tool in the workpiece bore to achieve a specific stock removal. The honing process does not require multiple steps as in prior art honing processes wherein tools of different sizes are used in successive steps during the honing process.

The sleeve is provided with a longitudinal slot that permits the diameter of the tool to expand as a tapered mandrel is adjusted relative to the sleeve, either by pulling or pushing the mandrel. The surface of the sleeve is nickel-plated with diamond granules in a spiral pattern, the grit size of the granules being chosen for a particular machining function depending upon the structure of the part, the material compensation, the coolant quantity and the tool cutting rate that are chosen. Stock can be removed to achieve bore diameter changes of one micron or less. Concentricity of the centerline of the bore can be maintained at a value of 1.15 micrometers or less, and roundness can be controlled to values within a range of zero to 1.15 micrometers.

The surface of the workpiece can be deposited in a spiral pattern wherein spaces adjacent diamond-plated portions of the surface accommodate coolant flow as the coolant flushes away the workpiece material during the honing operation.

The honing tool assembly of the invention has a tapered central opening in the sleeve. A mandrel rod with a tapered external surface engages the tapered wall of the sleeve opening throughout the length of the opening.

The sleeve and the diamond granule plating have a longitudinal slot along the length of the sleeve to permit the effective sleeve diameter to expand as a longitudinal pulling or pushing force is applied to the mandrel.

DETAILED DESCRIPTION OF THE PREFERRED EMBODIMENT(S)

Figure 1:
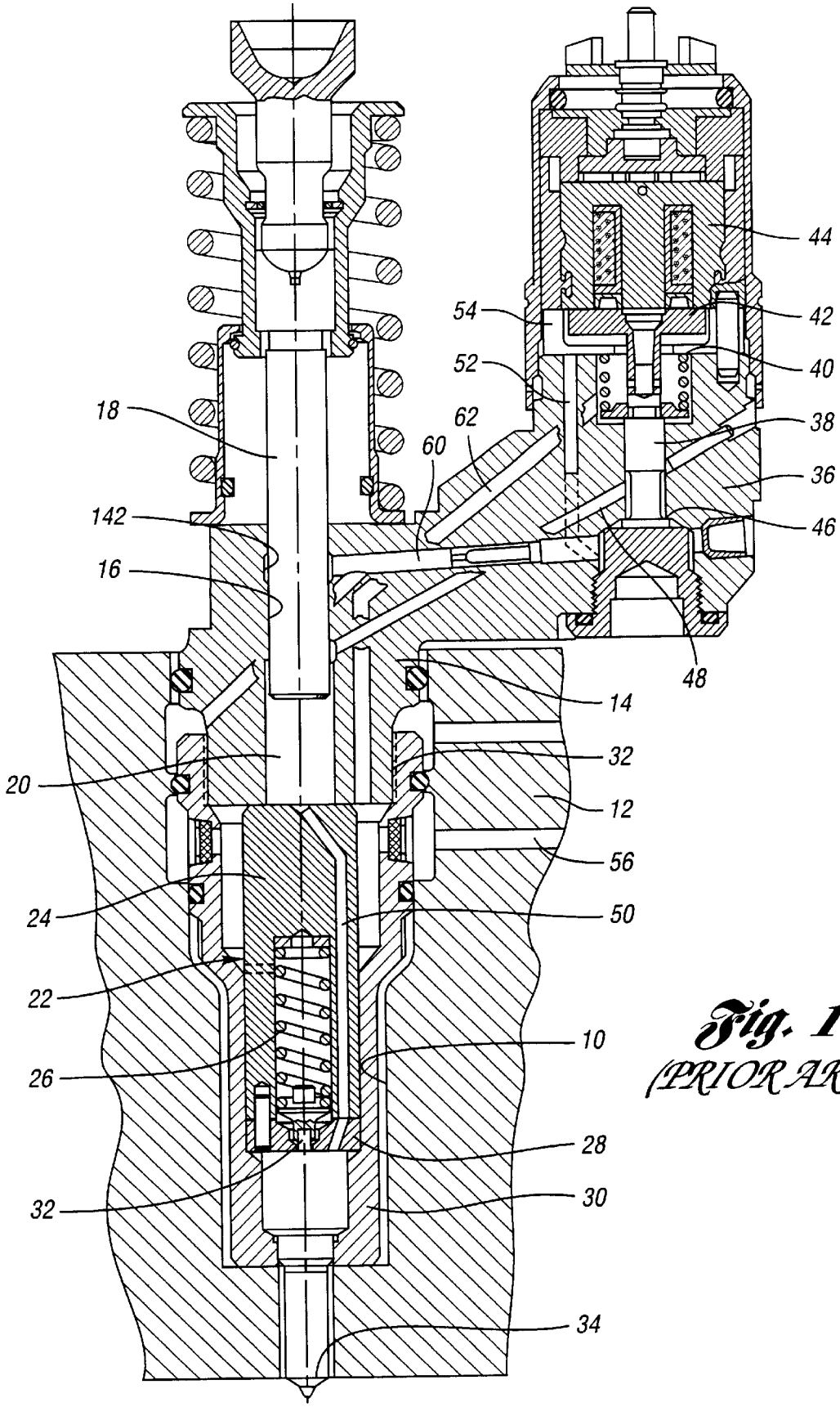
Fig. 1 (PRIOR ART)
FIG. 1 is a cross-sectional view of a diesel fuel injector pump for use with a diesel engine wherein the pump body is provided with a precision-machined bore, which receives the pump piston plunger.

FIG. 1 shows a diesel fuel unit injector pump, which is received in an injector nozzle opening 10 formed in a diesel engine cylinder body 12. The pump comprises a pump body 14, which is formed with a precision pump bore 16. Plunger 18, received in the bore 16, defines with the bore 16 a fuel pumping chamber 20.

A nozzle assembly 22 comprises a spring cage 24 containing a needle valve spring 26. A needle valve housing 28 is received in a nozzle assembly nut 30, which is threaded at 32 to the pump body 14. The needle valve body 28 receives a needle valve element 32, which registers with openings formed in a nozzle tip 34. For a complete description of a nozzle assembly of the kind generally indicated in FIG. 1, reference may be made to copending patent application Ser. No. 10/126,811, filed Apr. 19, 2002, by Gary L. Cowden, entitled "Fuel Injection Nozzle with Pressurized Nozzle Needle Valve" (DDTC 0217 PUS). This co-pending patent application is owned by the assignee of the present invention.

In the case of the unit pump construction of FIG. 1, the cylinder body 14 has an extension 36, which defines a control valve housing. Control valve 38 is disposed in a control valve chamber in the housing 36. Valve 38 is biased toward an open position by control valve spring 40. An armature 42, secured to the valve 38, is moved in an upward direction, as viewed in FIG. 1, by solenoid actuator 44. This closes the control valve opening at 46. The spring 40 tends normally to open the control valve opening 46.

A fuel feed passage 48 communicates with a low-pressure fuel pump and distributes fuel to pumping chamber 20. When the valve 38 is closed, stroking of the piston 18 will cause a pressure buildup in pressure chamber 20, thereby distributing high pressure fuel through nozzle passage 50 to the needle valve assembly. When the pressure in passage 50 increases, the needle valve is opened against the force of spring 26.

Passage 48, when the valve is open, communicates with passage 52, which extends to the armature chamber 54. Fuel may pass through a central opening in the valve 38 to the low-pressure return passage 60. Fuel supplied to the pump through fuel supply passage 56 is distributed to the spring chamber for spring 40 through supply passage 62.

Figure 2:
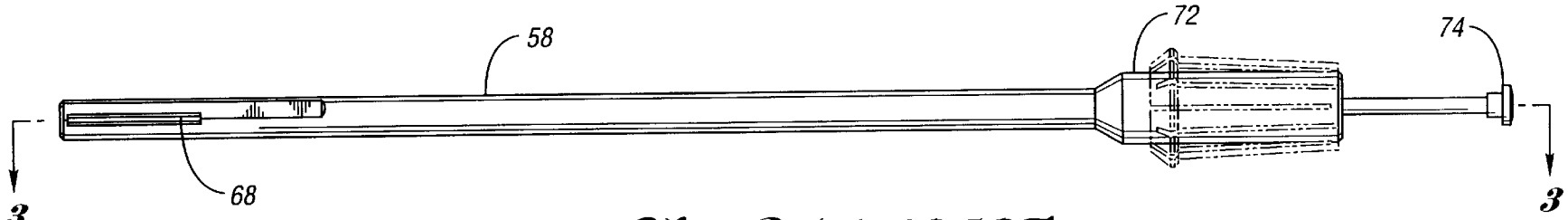
Fig. 2 (PRIOR ART)
FIG. 2 is a plan view of a honing tool of known construction for machining a bore of the kind shown in FIG. 1.

FIG. 2 shows a honing tool of known construction. It comprises a cylindrical sleeve 58 received in the bore of a workpiece such as the cylinder housing 14. The sleeve has a central opening that receives an actuator rod 60. A tapered surface 62 at the innermost end of the rod 60 engages a tapered surface 64 on a honing tool insert 66, which is received in a slot 68 in the sleeve 58. The slot 68 extends longitudinally. The insert 66 has an abrasive surface 70, which engages the inner wall of the bore in the workpiece.

The right-hand end 72 of the sleeve 58 can be chucked in a driving spindle of a rotary spindle machine (not shown). The right end of the actuator rod 60 extends outwardly from the sleeve 58, as shown at 74. A force can be applied to the actuator rod 60 to provide radial adjustment of the insert 66. When the rod 60 is moved inwardly, the insert 66 moves radially outward through its slot 68 formed in the sleeve 58.

Figure 3:
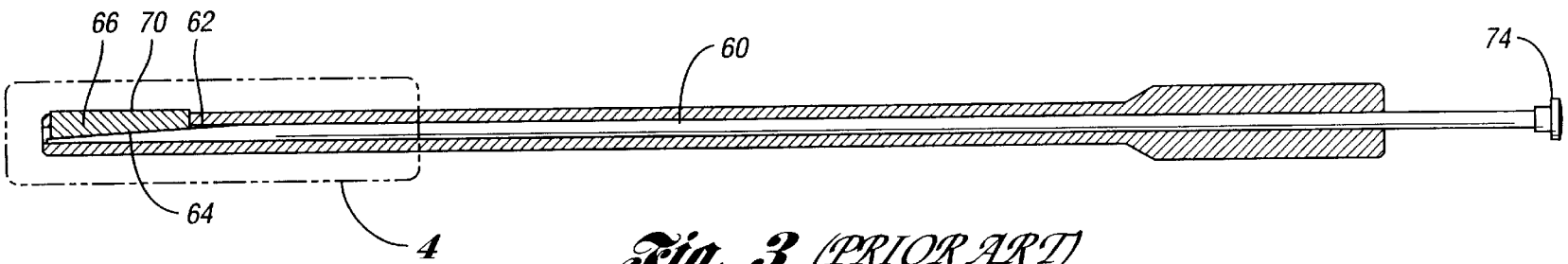
Fig. 3 (PRIOR ART)
FIG. 3 is a cross-sectional view of the tool shown in FIG. 2 taken along the plane of section line 3—3 of FIG. 2.
Figure 4:
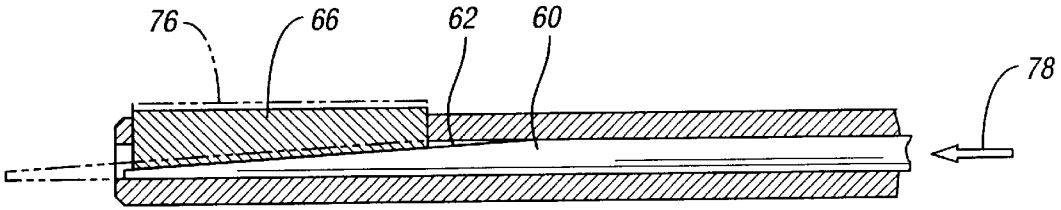
Fig. 4 (PRIOR ART)
FIG. 4 is a cross-sectional view of the end of the tool of FIG. 2 showing a metallic honing tool insert.

FIG. 3 shows the rod 60 in its right-hand position whereby the insert 66 is moved radially inward. When the rod is shifted in the left-hand direction as viewed in FIG. 4, the tapered surface 62 engages the insert 66 and adjusts it radially outward, whereby the abrasive material schematically shown in FIG. 4 at 76 engages the inner wall of the bore. The direction of the force on the rod 60, which causes a radially outward adjustment of the insert 66, is shown at FIG. 4 at 78.

Figure 5:
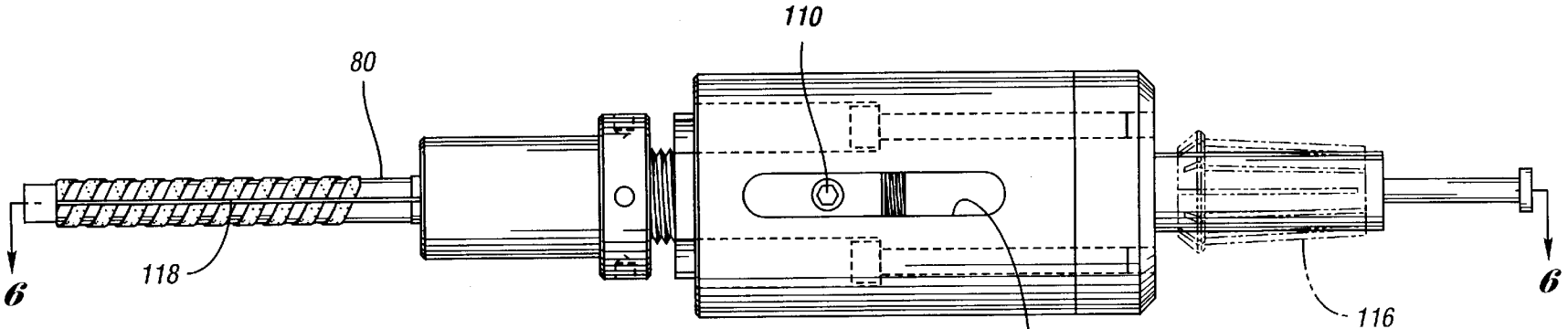
FIG. 5 is a plan view of the honing tool of the present invention mounted in a honing tool holder, which is used to secure the honing tool in a honing tool spindle machine.

FIG. 5 shows the honing tool of the invention at 80. The right-hand end of the tool 80 is received in a tool adaptor 82, which is provided with a threaded extension 84 with an opening 86 that receives the right-hand end of the tool 80.

Figure 6:
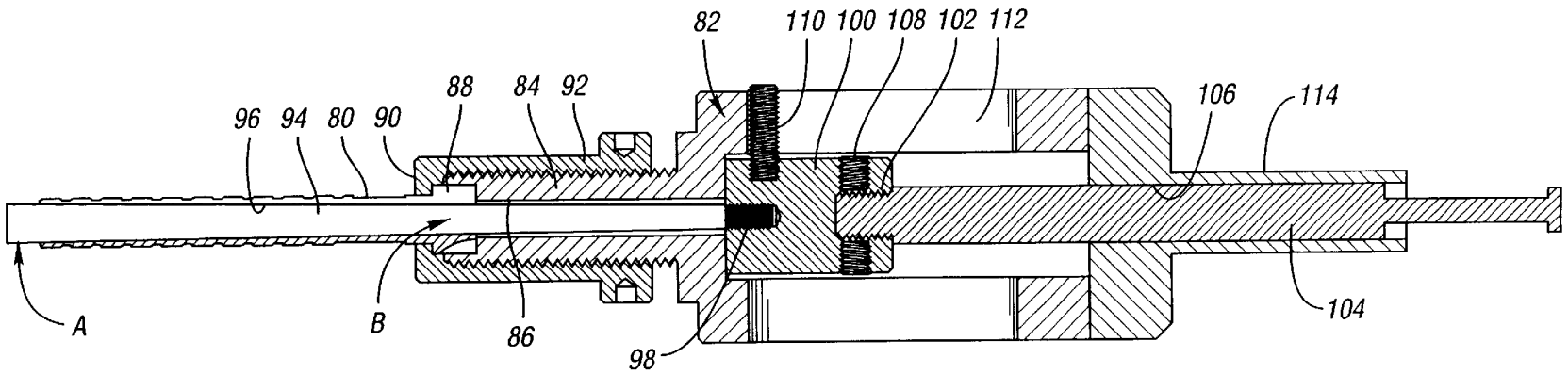
FIG. 6 is a cross-sectional view of the tool of FIG. 5, as seen from the plane of cross-section 6—6 of FIG. 5.

A shoulder 88 formed on the tool 80 is engaged by an annular shoulder 90 on a clamping nut 92, which is internally threaded on the extension 84. When the nut 92 is tightened, as shown in FIG. 6, the tool 80 is held fast by the adapter 82.

A tapered mandrel 94 is received in a central opening 96 of the tool 80. The opening 96 is tapered with a progressively decreasing diameter, as viewed in FIG. 6, extending from point A to point B. The right-hand end of the mandrel is threadably connected at 98 to a slide element 100. The right-hand end of the slide element 100 is threadably connected at 102 to actuator rod 104 extending through an opening 106 in the adapter 82. Lock screws 108 in the slider element 100 can be used to lock the rod 104 to the slide element.

A guide screw 110, carried by the slider element 100, extends through an opening 112 in a housing of the adapter 82. The guide screw 110 reciprocates in the opening 112 and prevents rotary motion of the slide element 100 relative to the housing of the adapter 82.

The housing of adapter 82 has an extension 114, which can be chucked, as shown schematically at 116 in FIG. 5, thereby permitting the tool 80 to be rotated by a spindle head for a honing machine apparatus (not shown).

Figure 7:
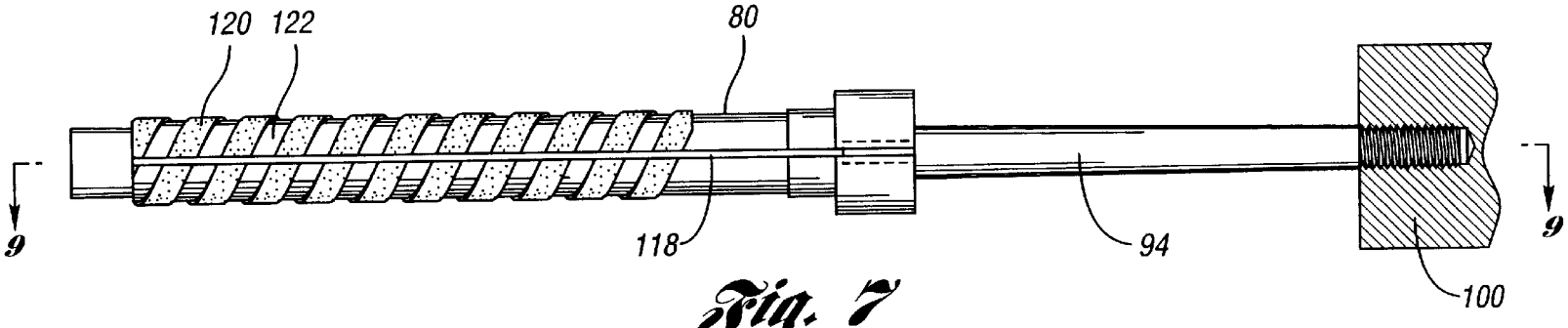
FIG. 7 is an enlarged view of the honing tool shown in FIG. 5.
Figure 8:
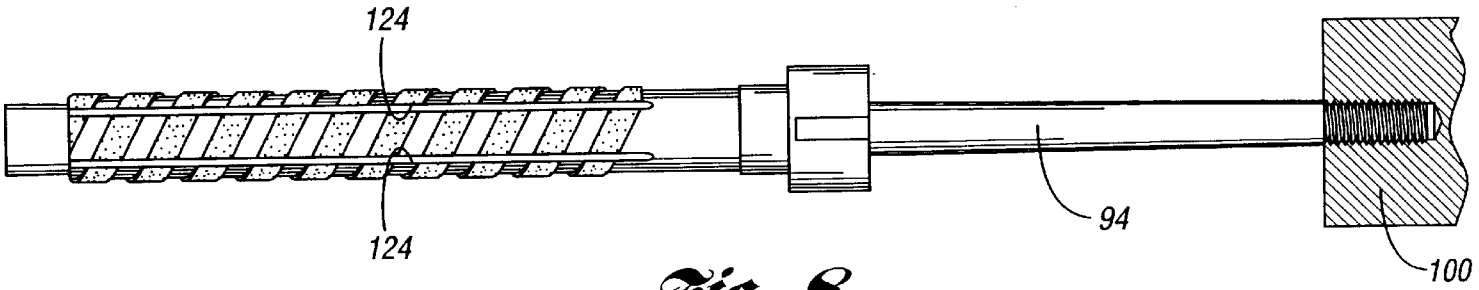
FIG. 8 is a view of the honing tool of FIG. 7, as viewed from a perspective displaced 90° from the position of the tool as shown in FIG. 7.
Figure 9:
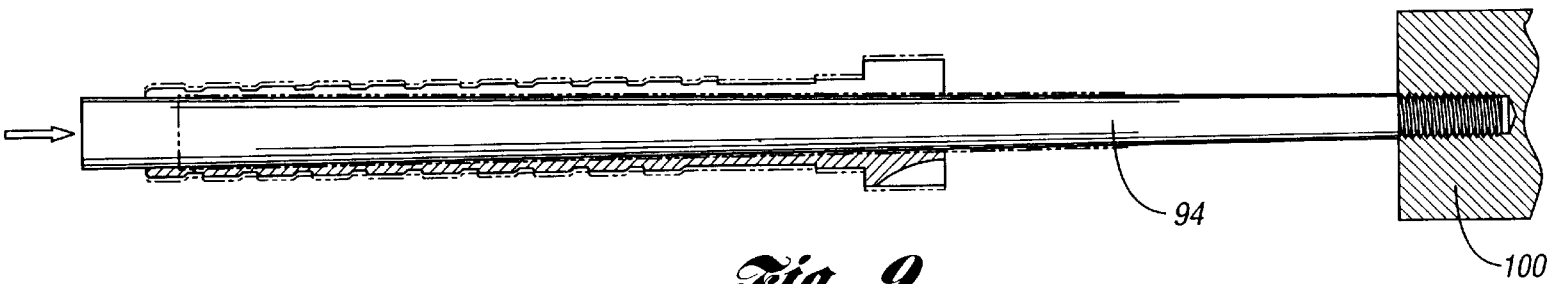
FIG. 9 is a cross-sectional view of the tool of FIG. 7 as seen from the plane of section line 9—9 of FIG. 7.

The tool 80, as shown in FIGS. 7–9, has a cylindrical sleeve and is formed with a longitudinally extending slot 118. The outer cylindrical surface of the sleeve of tool 80 is provided with diamond plating 120, which is electrodeposited in a spiral pattern as illustrated in FIGS. 7 and 8. Unplated portions 122 of the surface of the tool 80 permit through-flow of cooling fluid and discharge of workpiece material as the tool rotates and reciprocates within the bore of the workpiece.

The cylindrical surface of the sleeve of tool 80 also is provided with longitudinally extending flushing grooves 124, as seen in FIG. 8.

When the mandrel 94 is moved relative to the tool 80 in a right-hand direction, the effective diameter of the sleeve of tool 80 will change as the gap at the slot 118 expands. Although a pulling force is applied to the mandrel 94 of FIGS. 7–9, as indicated by the force vector in FIG. 9, a pushing or compression force could be used if the disposition of the mandrel and sleeve relative to slide element 100 were to be reversed.

The diamond plating shown at 120 is deposited on the surface of the tool during manufacture of the tool using an electrostatic technique. The tool 80 is emerged in a nickel compound bath with nickel ions in solution. Diamond granules are dispersed in the nickel compound bath as an electric charge is applied to the tool and an opposite charge is applied to the container for the bath. The spaces shown at 122 are masked during this electro-depositing step so that the diamond granules, together with the nickel plating, are deposited only on the non-masked portion of the surface. The nickel plating acts as a bond between the diamond granules and the outer surface of tool 80.

Nickel-diamond plating techniques have been used in manufacturing honing tooling by Accu-Cut Diamond Tool Company, Inc., 4238-40 N. Sayer, Norridge, Ill. 60706.

Figure 10:
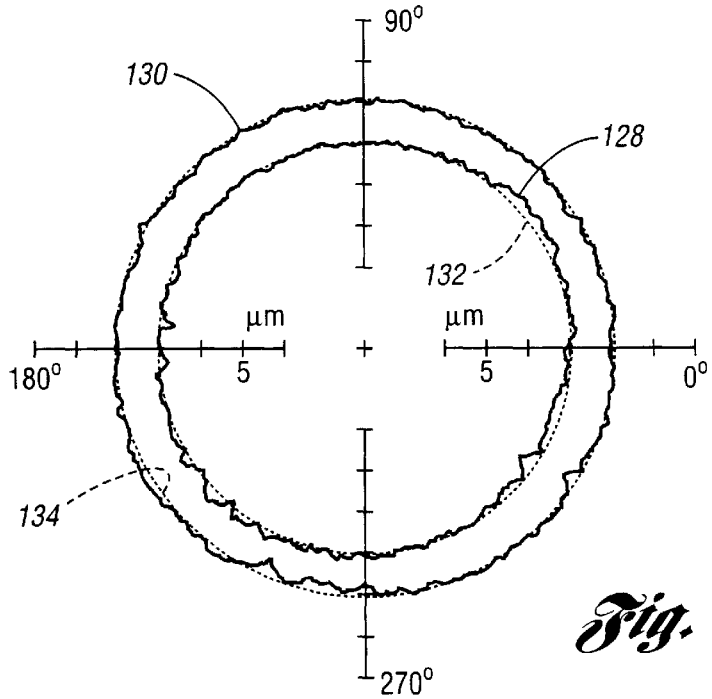
FIG. 10 is an out-of-roundness measurement trace for a bore wall taken at two longitudinally spaced locations on the axis of the bore in a workpiece.

FIG. 10 shows a test trace of the roundness of a honed workpiece bore after it is machined using the tool of the present invention. In the case of FIG. 10, the plots for the out-of-roundness are developed using measurements in each of two axially spaced locations. The actual diametrical measurements at various angular locations of the bore are plotted at 128 in the case of measurements taken at one location, and at 130 in the case of measurements taken at the second location. The bore diameter is indicated by the circle 132 and by the circle 134, respectively, for the two locations.

The maximum deviation of the roundness measurement may be as low as 1.15 micrometers (1.15 $\mu$m).

Figure 11:
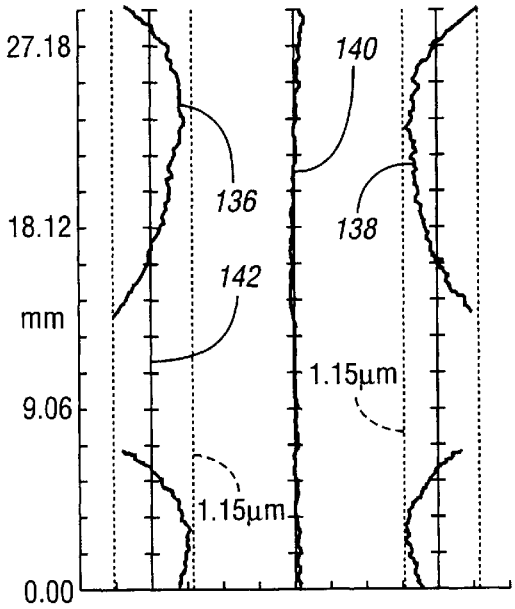
FIG. 11 is a concentricity measurement trace at the left and right sides of a workpiece bore wall and at the center of the bore, the measurements being taken at multiple locations along the axis of the workpiece.

FIG. 11 shows the measurements of concentricity at various stations along the axis of the finished workpiece after the workpiece has been machined using the tool of the present invention. The concentricity at the left side of the wall is shown by the trace 136 and the corresponding reading for the right side of the bore wall is shown at 138. The centerline measurements for the bore are plotted at 140.

Figure 12:
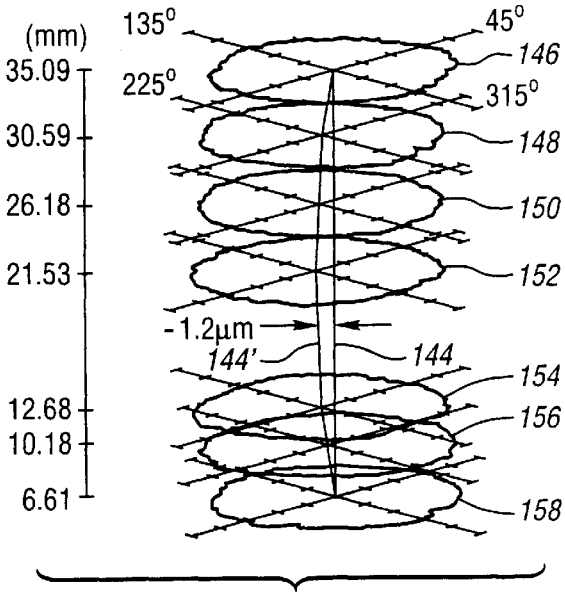
FIG. 12 is a measurement trace of the center of a workpiece bore taken at seven locations along the axis of the bore.

FIG. 12 is a plot of the centers for the roundness measurements taken at seven locations, 146 through 158, along the axis 144 of the bore. The centers are plotted at 144'. The line of the centers is bow-shaped, the maximum deviation occurring near the mid-position. The deviation near the mid-position is about 1.2 $\mu$m.

In the case of a rough workpiece having an initial out-of-roundness of 50–70 $\mu$m, for example, the honing operation can be carried out in successive steps. A tool with a relatively coarse diamond grit can be used in the initial step. That can be followed by one or more steps using tools with finer grit size. The test results shown in FIGS. 10, 11 and 12 are the results obtained typically in the final honing step using the tool of the present invention.

The bore can be provided with an annular counterbore using an ECM machining technique, as indicated at 142 in FIG. 1. This results in the null region 142 in the trace diagram of FIG. 11. The maximum out-of-roundness indicated in the plot of FIG. 11 is 1.15 micrometers or less, as previously indicated, and the out-of-concentricity is almost imperceptible, as indicated at 140.

The diamond chip or diamond granule size that is used with the tool 80 to develop traces of FIGS. 10 and 11 is about 2–4 microns. These diamond granules are bonded during the nickel plating process in the spiral pattern indicated in FIGS. 7, 8 and 9.

Although an embodiment of the invention have been described, it will be apparent to persons skilled in the art that modifications may be made without departing from the scope of the invention. All such modifications and equivalents thereof are intended to be covered by the following claims.

What is claimed is:

1. A honing tool assembly for precision machining a cylindrical bore in a workpiece comprising a sleeve, the sleeve having a cylindrical outer surface and an axis of rotation, an opening in the sleeve, the sleeve opening having a tapered wall and an axis coinciding with the axis of rotation;

a mandrel extending through the sleeve opening, a tapered external surface on the mandrel engaging the tapered wall of the sleeve opening along the length of the opening; and diamond granule plating disposed in a spiral pattern on the outer surface of the sleeve;

the sleeve and the diamond granule plating having a longitudinal slot extending along the length of the sleeve, whereby the effective outside diameter of the sleeve is expanded as a longitudinal force is applied to the mandrel;

the sleeve and the mandrel being adapted to be mounted in a spindle machine for rotation about the axis of the sleeve as relative reciprocating motion of the workpiece and the sleeve occurs in the direction of the axes;

a rotary adapter having an externally threaded extension with a central opening with an axis coincident with the axis of rotation;

a retainer shoulder on the sleeve; and a clamping nut threadably connected to the threaded extension, the clamping nut engaging the retainer shoulder to secure the sleeve against the adapter for rotation about the axis of rotation.

2. A honing tool assembly for precision machining a cylindrical bore in a workpiece comprising a sleeve, the sleeve having a cylindrical outer surface and an axis of rotation, an opening in the sleeve, the sleeve opening having a tapered wall and an axis coinciding with the axis of rotation;

a mandrel extending through the sleeve opening, a tapered external surface on the mandrel engaging the tapered wall of the sleeve opening along the length of the opening;

the sleeve and the mandrel being adapted to be mounted in a spindle machine for rotation about the axis of the sleeve as relative reciprocating motion of the workpiece and the sleeve occurs in the direction of the axes;

a rotary adaptor having an externally treaded extension with a central opening with an axis coincident with the axis of rotation;

a retainer shoulder on the sleeve;

a clamping nut threadably connected to the treaded extension, the clamping nut engaging the retainer shoulder to secure the sleeve against the adapter for rotation about the axis of rotation; and diamond granule plating disposed in a spiral pattern on the outer surface of the sleeve;

the sleeve and the diamond granule plating having a longitudinal slot extending along the length of the sleeve, whereby the effective outside diameter of the sleeve is expanded as a longitudinal force is applied to the mandrel;

the adapter having a slide element and an actuator rod, the slide element being connected to the actuator rod and the mandrel whereby longitudinal reciprocating relative motion of the workpiece and the tool sleeve is achieved as the actuator rod is reciprocated;

the slide element and the adapter having a sliding connection for accommodating relative longitudinal motion while preventing relative rotation therebetween.

* * * * *